United States Patent [19]

Krause

[11] Patent Number: 4,527,764

[45] Date of Patent: Jul. 9, 1985

[54] DRY SOAP DISPENSER

[76] Inventor: Vernon C. Krause, 480 John Ward Rd., Marietta, Ga. 30064

[21] Appl. No.: 542,593

[22] Filed: Oct. 17, 1983

[51] Int. Cl.[3] ..... A47K 5/08

[52] U.S. Cl. ..... 248/309.1; 312/351; 206/77.1

[58] Field of Search ..... 312/351, 352; 248/309.1, 205.3, 306, 316, 300; 206/77.1

[56] References Cited

U.S. PATENT DOCUMENTS

| | | | |
|---|---|---|---|
| 2,842,893 | 7/1958 | Howerton | 206/77.1 |
| 2,908,995 | 10/1959 | Seamon | 206/77.1 |
| 2,930,160 | 3/1960 | Pohl | 206/77.1 |
| 4,313,537 | 2/1982 | Collet | 206/77.1 |
| 4,392,630 | 7/1983 | Moontasir | 312/351 |
| 4,435,030 | 3/1984 | Haven | 312/351 |

FOREIGN PATENT DOCUMENTS

| | | | |
|---|---|---|---|
| 2658871 | 7/1977 | Fed. Rep. of Germany | 248/205.3 |

*Primary Examiner*—Reinaldo P. Machado
*Assistant Examiner*—Alvin Chin-Shue
*Attorney, Agent, or Firm*—Thomas & Kennedy

[57] ABSTRACT

A soap bar dispenser has a support strap mountable atop a horizontal support surface, an inclined ramp 12 supported by the support strap, and a raised stop 18 located adjacent a lower end of the ramp. A slide plate 24 is supported upon the ramp for movement between a soap bar holding position with a lower end of the slide located at a relatively low position with respect to the stop and a soap bar dispensing position with a lower slide end located at a relatively high position with respect to the stop.

2 Claims, 4 Drawing Figures

DRY SOAP DISPENSER

TECHNICAL FIELD

This invention relates generally to soap bar holders and dispensers.

BACKGROUND OF THE INVENTION

Soap in bar or cake form is typically held in shallow trays or recesses formed in countertops or in the wings of sinks adjacent a water faucet. In use a soap bar is merely lifted off the tray or the recess for use as in washing hands and faces. After such usage the bar is manually replaced in the tray or recess.

There is a problem commonly associated with the just described soap bar holders. Specifically, once a bar of soap has been moistened, used and then replaced upon a tray, or recess-type holder formed integrally with a sink, it tends to stick to its supporting surface. Thus, the next time a person seeks to lift the soap bar resistance is encountered. This forces the latter user to slide, twist or perhpas pry a finger under a corner of the soap bar in order to lift it from its supporting surface. In addition, the surface of the holder itself tends to become coated with a layer or slurry of soap which is messy, unsightly and gives the appearance of an unsanitary condition. Accordingly, it would be desirable to provide a soap bar holder and dispenser that is substantially free of the just described problems. It is to the provision of such a dispenser that the present invention is primarily directed.

SUMMARY OF THE INVENTION

Briefly described, the present invention comprises a holder and dispenser for dry soap bars. In the disclosed embodiment of the invention the soap bar dispenser comprises a support strap adapted to be mounted atop a generally horizontal support surface, an inclined ramp supported by the support strap, and a raised end wall or stop located adjacent a lower end of the ramp. A slide plate is supported upon the ramp for movement between a soap bar holding position with a lower end of the slide located at a relatively low position with respect to the stop and a soap bar dispensing position with the lower slide end located at a relatively high position with respect to the stop.

A lift tab extends from the slide by which a lower end of the slide may be manually lifted off the ramp to enable a soap bar supported thereon to pass over the stop and off the slide.

A bar of soap is placed on its edge in the soap holder, so that one edge rests against the slide plate and an end of the soap bar abuts the lower end wall. When the lower end of the slide plate is lifted, the bar of soap is lifted above the lower end wall and slides into the hands of the user.

Thus, it is an object of this invention to provide a holder for a bar of soap which holds the soap in an elevated position at a wash basin and which conveniently dispenses the bar of soap to the hands of a person at the wash basin, and which is conveniently positioned to receive the soap after use.

Another object of the invention is to provide a soap bar holder and dispenser that maintains a bar of soap in a dry condition at a wash basin and which is conveniently operated to eject the bar to the hands of the user.

Other objects, features and advantages of the invention will become apparent upon reading the following specification, when taken in conjunction with the accompanying drawings.

DETAILED DESCRIPTION

Figure 1:
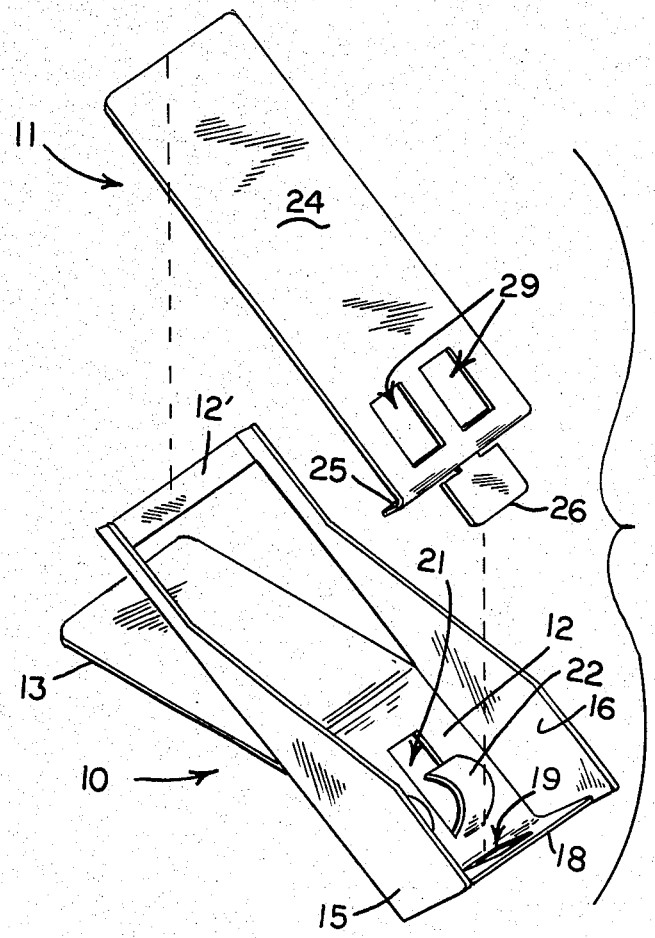
FIG. 1 is an exploded view, in perspective, of the soap bar dispenser embodying the principles of the present invention.
Figure 2:
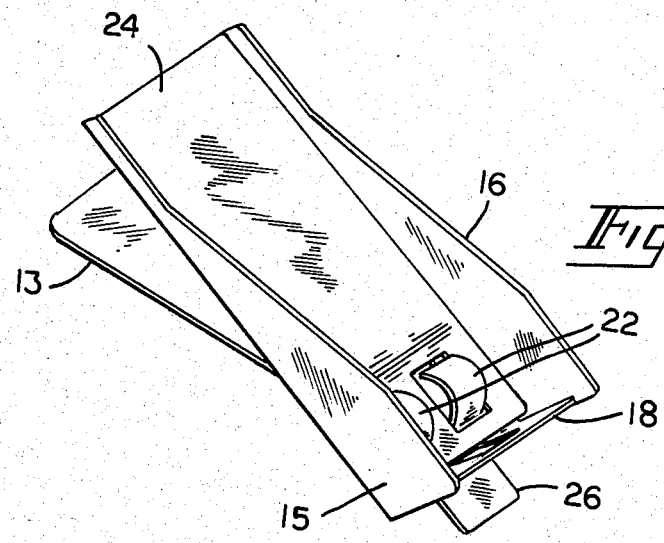
FIG. 2 is an assembled view, in perspective, of the soap bar dispenser illustrated in FIG. 1.
Figure 3:
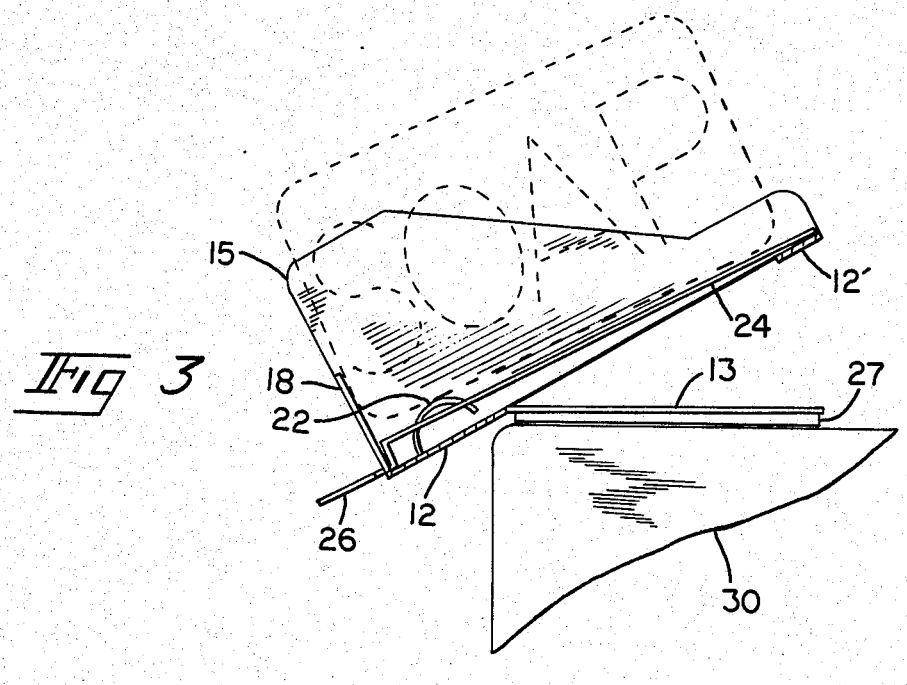
FIG. 3 is a side elevational view of the soap bar dispenser illustrated in FIGS. 1 and 2 shown mounted to a supporting surface in a soap bar holding position with one side wall removed.
Figure 4:
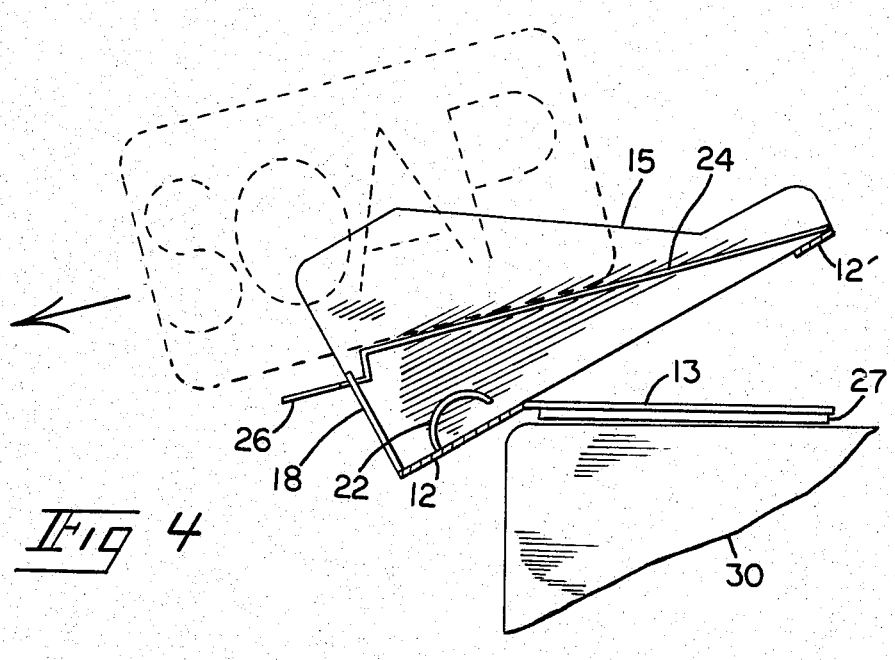
FIG. 4 is another side elevational view of the soap bar dispenser as illustrated in FIG. 3 but in a soap bar dispensing position.

Referring now in more detail to the drawings, in which like numerals indicate like features throughout the several views, FIG. 1 illustrates a soap bar dispenser having two separate components made from sheet metal which include a receptacle 10 and a slide plate or tongue 11. The receptacle 10 is formed from a single sheet of metal so as to have a ramp 12 from which a support strap 13 is struck and angularly extends. A layer of pressure sensitive adhesive 27 is mounted to the bottom of the support strap 13 as shown in FIGS. 3 and 4. Two side walls 15 and 16 extend upwardly from the ramp 12 as does an end wall 18 which is formed with a slot 19. The two ends of side walls 15 and 16 located distal the end wall 18 are spanned by an upper ramp section 12' which is coplanar with ramp 12. Thus, the ramp may be considered as being bifurcated.

The ramp 12 is formed with two slots 21 with the material struck from the ramp being itself formed into two arcuate islands or ribs 22 that extend above the ramp. The slide 11 is seen to have a flat, rectangular section 24 with a down turned lip or flange flange 25 at its lower end from which a lift tab 26 projects through and beyond opening 19 in end wall 18, parallel with section 24. The slide plate 11 is loosely attached to the receptacle by turning the slide on end, passing the lift tab 26 through the slot 19 in end wall 18, then reorienting the slide plate parallel to the ramp and setting it on the ramp with the two arcuate islands 22 projecting through two slots 29 formed in the slide plate.

In use the soap bar dispenser can be mounted atop a wash basin or other support 30 as shown in FIGS. 3 and 4 with the support strap 13 supported upon a top surface of the support and adhered thereto by the pressure sensitive adhesive 27 and with the ramp 12 jutting out over an edge of the support 30. As shown in FIG. 3 a bar of soap can be then placed, as shown in outline form, within the device with a lower end of the bar resting in abutment against the end wall 18 and upon the two arcuate islands or ribs 22 and with the lower edge of the bar of soap adjacent the slide plate 24. The raised rear lower end of the bar of soap rests directly upon the slide plate 24 but otherwise the bottom surface of the bar of soap is raised off of the slide plate.

To dispense the bar of soap from the device one merely lifts the lift tab 26 as with a finger to the position shown in FIG. 4 while holding his palm open. The bar of soap will thereupon slide down the inclined slide plate into the palm of the user's hand by passing above the end wall or stop 18. In doing so the soap bar will tend not to adhere significantly to the surface of the slide plate since it has not been left flat atop it. In raising the lift tab 26 the bar is forced completely out of engagement with the lower end wall 18 and with the two raised islands 22 to which it could have stuck. The only remaining adherence is where the rear end edge of the soap has made line contact with the slide as shown in FIG. 3. Once the bar of soap has been dispensed into the palm of the user's hand the lift tab is released whereupon the slide returns to its lowered position as illustrated in FIG. 3. After having finished using the bar of soap the user may replace it upon the device as initially shown in outline form in FIG. 3.

It thus is seen that a soap bar dispenser is provided which is quite effective in use in that it avoids a user having to manually break a bar loose from its supporting surface. Once used a soapy coating does not tend to form upon its supporting surface to a substantial degree. The dispenser is relatively easy to use since it may be operating by merely lifting a lift tab with a finger whereupon the soap falls into the hand of the user used in raising the lift tab thereby leaving the other hand free. That it is of open top construction facilitates replacement of the bars and also provides ready indication of the soap supply status. Also, the upper portion of the bar of soap is exposed so that the user can grasp the soap without lifting the slide plate and lift the soap from the dispenser. Moreover, since the slide plate 24 is loosely retained in the receptacle 10, the lift tab can be pressed down and the upper end of the slide plate will tilt up, thereby tilting the bar of soap over the lower end wall 18 and into the hands of the user.

That the device is made from sheet metal or plastic and consists merely of two unitary structures without any other components necessarily affixed thereto, other than the strip of pressure sensitive adhesive, renders it of simple and economic construction.

If it should be desired to mount the soap holder from a surface that is not horizontal, the support strap 13 can be bent as necessary to assume the desired attitude. Also, the support strap 13 can be struck from the ramp 12 in the opposite direction, so that it would normally be oriented in a vertical attitude for mounting to a vertical surface.

It should be understood that the just described embodiment merely illustrates principles of the invention in one preferred form. Many modifications, additions and deletions may, of course, be made thereto without departure from the spirit and scope of the invention as set form in the following claims.

I claim:

1. A soap bar dispenser comprising a support strap adapted to be mounted atop a generally horizontal support surface; an inclined ramp supported by said support strap; said ramp having a raised island; a raised stop located adjacent a lower end of said ramp; and a slide having an opening through which said island may project; said slide being supported upon said ramp for movement between a soap bar holding position with a lower end of said slide located at a relatively low position with respect to said stop and a soap bar dispensing position with said lower slide end located at a relatively high position with respect to said stop.

2. A soap bar dispenser comprising an inclined ramp having at least one raised island upon which a soap bar can be supported; a stop extending upwardly from a lower end of said ramp; a pair of side walls extending upwardly from opposite sides of said ramp; a slide detached from but resting upon said ramp between said side walls upon which a soap bar may be supported in abutment with said stop and with said slide defining at least one opening through which said ramp island extends; and a lift tab extending from said slide by which a lower end of said slide may be manually lifted off said ramp to enable a soap bar supported thereon to pass over said stop and slide off said slide.

* * * * *